United States Patent [19]

Lin

[11] Patent Number: 4,963,879

[45] Date of Patent: Oct. 16, 1990

[54] DOUBLE SKIRT OMNIDIRECTIONAL DIPOLE ANTENNA

[75] Inventor: Jonathan X. Lin, Dallas, Tex.

[73] Assignee: Alliance Telecommunications Corp., Dallas, Tex.

[21] Appl. No.: 387,007

[22] Filed: Jul. 31, 1989

[51] Int. Cl.[5] ..... H01Q 9/20

[52] U.S. Cl. ..... 343/792; 343/862

[58] Field of Search ..... 343/790–792, 343/890, 891, 853, 862, 820, 822, 827

[56] References Cited

U.S. PATENT DOCUMENTS

| | | | |
|---|---|---|---|
| 2,199,375 | 4/1940 | Lindenblad | 343/790 |
| 2,821,709 | 1/1958 | Fucci | 343/790 |
| 3,000,008 | 9/1961 | Pickles | 343/792 |
| 3,750,181 | 7/1973 | Kuecken | 343/790 |
| 4,369,449 | 1/1983 | MacDougall | 343/792 |

FOREIGN PATENT DOCUMENTS

| | | | |
|---|---|---|---|
| 1013723 | 8/1957 | Fed. Rep. of Germany | 343/792 |

*Primary Examiner*—Michael C. Wimer

*Attorney, Agent, or Firm*—Richards, Medlock, & Andrews

[57] ABSTRACT

An omindirectional antenna includes one or more dipole radiators. Each dipole radiator comprises a first and second cylindrical radiating element. Each radiating element includes an end plate for mounting the radiating element coaxially on a tubular mast. The cylindrical radiating elements, end plates and tubular mast are all DC connected. A feed line is provided which may extend through the center of the mast and exit at an opening for connection to a secondary feed line. The secondary feed line is connected to an end of one of the cylindrical radiating elements of each pair of elements for each dipole radiator. The feed line is connected to the end of the cylindrical radiating element opposite the end plate. The configuration of the dipole radiators is such that the radiator functions an an RF choke for the adjacent radiators. An additional single cylindrical element can be provided at the end of a plurality of dipole radiators to provide RF choking for the immediately adjacent dipole radiator. A plurality of main feed lines may be included to extend through the center of the mast with corresponding openings for connection to secondary feed lines.

16 Claims, 2 Drawing Sheets

DOUBLE SKIRT OMNIDIRECTIONAL DIPOLE ANTENNA

FIELD OF THE INVENTION

The present invention pertains in general to radio frequency radiating and receiving antennas and in particular to an omnidirectional dipole antenna.

BACKGROUND OF THE INVENTION

Many radio communications systems, such as used with cellular telephones, use a central base station antenna. Such a base station antenna must have an omnidirectional antenna pattern for transmission and reception in all directions. It is further desirable that antennas of this type have a narrow beam directed laterally toward the users rather than being directed upward and thereby wasted.

Prior omnidirectional antennas are shown in U.S. Pat. No. 4,369,449 to MacDougall; U.S. Pat. No. 4,117,490 to Arnold et al.; and U.S. Pat. No. 3,159,838 to Facchine. The patent to MacDougall describes a linearally polarized omnidirectional antenna. This antenna has one or more dipoles each having an elongated tubular conductive radiator of a length that is about half the wave length of the mid-band frequency. The antenna includes a mast or center tube which is electrically isolated from the cylindrical radiator along the entire length of the radiator. The antenna feed structure is positioned totally within mast with connection points to the radiators at the termination of the feed line. The patent to Arnold et al. describes an antenna array wherein an antenna structure includes spaced concentric cylindrical metal sleeves comprising an outer sleeve and an inner sleeve of equal length. The array comprises two of the antenna structures, one mounted on each strut of the landing gear of an aircraft. The patent to Facchine describes a vertically stacked dipole radiator which is mounted on a tubular mast. This antenna includes a plurality of dipole radiators. The dipole radiators are conical structures which have facing back-to-back closed ends.

The present invention is an improved antenna over the prior art. The antenna of the present invention provides an improved antenna pattern, less complexity, reduced cost of manufacture, greater lightning protection and improved repairability.

SUMMARY OF THE INVENTION

The present invention is directed to an omnidirectional antenna and includes both a dipole radiator for use in connection with the antenna as well as a complete antenna having multiple dipole radiators and a unique feed structure.

A selected embodiment of the present invention comprises an omnidirectional antenna which includes an electrically conductive, elongate mast having a plurality of dipole radiators mounted along the mast. Each of the dipole radiators includes a first cylindrical radiator element which has an end plate at a first end of the cylindrical radiator. The end plate has an opening therein for receiving the mast. The dipole radiator further includes a second cylindrical radiator element having an end plate at a first end of the radiator element. The end plate of the second radiator element has an opening therein for receiving the mast and is positioned to face the second end of the first radiator element. The mast, radiator elements and end plates are DC electrically connected. The omnidirectional antenna is provided with a feed line which is supported by the mast and connected to the first radiator element at a position which is proximate the second end thereof.

A further embodiment of the present invention is an omnidirectional antenna having a plurality of dipole radiators, described above, mounted at spaced apart positions along the mast. Likewise, the mast, radiator elements and end plates are DC electrically connected. The omnidirectional antenna includes a feed line which is supported by the mast and is connected to each of the first radiator elements in an area which is proximate the second end thereof.

A still further embodiment of the present invention is an omnidirectional antenna which has an electrically conductive, elongate hollow mast. A plurality of dipole radiators are mounted at spaced apart locations along the mast. Each of the dipole radiators includes a first cylindrical radiator coaxially mounted to the mast and a second cylindrical radiator element coaxially mounted to the mast offset from the first radiator element. A primary feed line is provided that extends from one end of the mast within the mast to an opening in the mast. The opening is located at approximately a midpoint of the plurality of dipole radiators mounted along the mast. The primary feed line extends through the opening. A secondary feed line is positioned external to the mast and is connected to the primary feed line at the opening in the mast. The secondary feed line extends in opposite directions along the mast from the opening. The secondary feed line is connected to each of the first cylindrical radiator elements of the dipole radiators.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
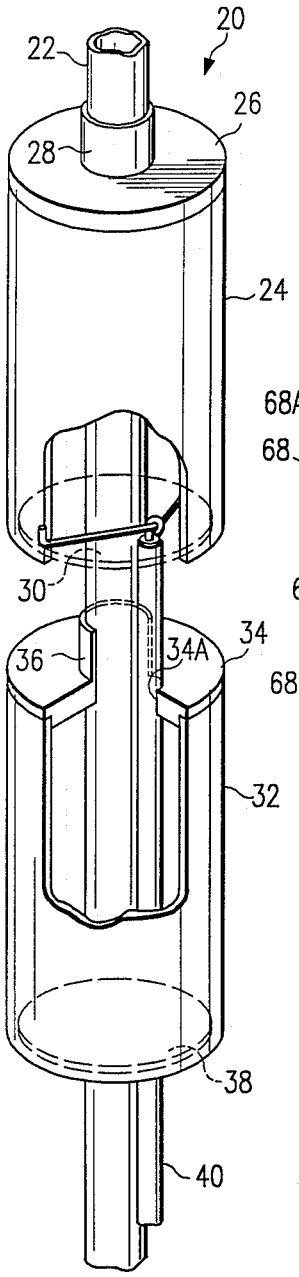
FIG. 1 is a perspective illustration of a dipole radiator in accordance with the present invention.

A dipole radiator 20 in accordance with the present invention is illustrated in FIG. 1. The radiator 20 is mounted on a tubular mast 22. A first cylindrical radiator element 24 is coaxially mounted on the mast 22 by means of an end plate 26 which has a bushing 28. Bushing 28 has an interior diameter which is approximately equal to the exterior diameter of the mast 22. In the illustrated embodiment, the cylindrical element 24 and end plate 26 are separate units which are bonded together by any one of many techniques including brazing, soldering or press fit. However, the assembly comprising element 24, plate 26 and bushing 28 can be fabricated as an integral unit.

Dipole radiator 20 may optionally include a cylindrical dielectric support 30 at the opposite end of the element 24 from the end plate 26. This would typically not be used unless the length of the element 24 exceeds 8 inches. For shorter lengths, the additional mechanical support provided by the dielectric support 30 is not required. The dipole radiator 20 is further equipped with a second cylindrical radiator element 32 mounted coaxially on the mast 22 offset from the element 24. The radiator element 32 is provided with an end plate 34 and a bushing 36. The element 32, plate 34 and bushing 36 correspond to the element 24, plate 26 and bushing 28 described above. The radiator element 32 is further provided, with an optional cylindrical dielectric support 38 at the end of the radiator element 32 opposite the plate 34.

A feed line 40 provides a radio frequency (RF) transmission path for both transmitted signals and received signals for the dipole radiator 20. Note that feed line 40 extends along the exterior surface of the mast 22 but within the cylindrical radiator element 32. The feed line 40 has a center conductor 42 which is connected at the center of a wire 44 that extends outward from the conductor 42 and is connected at substantially opposite edges of the radiator element 24 in a proximate area of the end of the element 24 opposite the plate 26. The wire 44 is preferably soldered to the conductor 42 and soldered to the interior of the element 24.

Further note that the end plate 34 has an opening 34A which permits the feed line 40 to pass therethrough. The bushing 36 has a slot opening therein which is aligned with the opening 34A. The feed line 40 passes through the slot in the bushing 36.

Brass is a preferred material for the mast 22, cylindrical radiator 24, end plate 26, bushing 28, cylindrical radiator 32, end plate 34 and bushing 36. These units are mechanically bonded or soldered together in such a fashion that there is a DC electrical connection between all of these elements. The mast 22 is securely connected to an earth ground thereby establishing a DC ground for all of the components of the dipole radiator 20. This configuration provides very good lightning protection for the dipole radiator 20 because any lightning discharge is directly shunted to ground rather than being permitted to arc across an isolated conductor thereby causing damage.

The spacing between the end plate 34 and the bottom of the cylindrical radiator element 24 is preferably 2% of the selected center frequency of operation for the dipole radiator 20. The combined length of the radiator element 24 and its radius is preferably equal to approximately one quarter of the wave length of this selected center frequency. Further, the ratio of the diameter of the mast to the diameter of the cylindrical radiating element should be less than 0.5. While the dipole radiator 20 may be operated at many frequencies, the present embodiment is designed for principle operation in the frequency range of 100 mhz to 1 ghz.

Figure 2A:
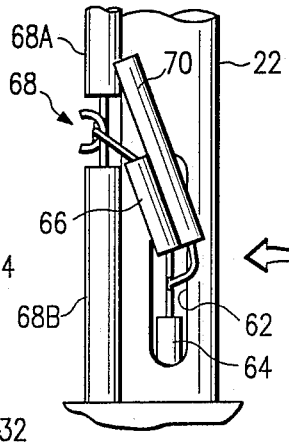
FIG. 2A is an enlarged illustration of a feed line junction point shown in FIG. 2.
Figure 2:
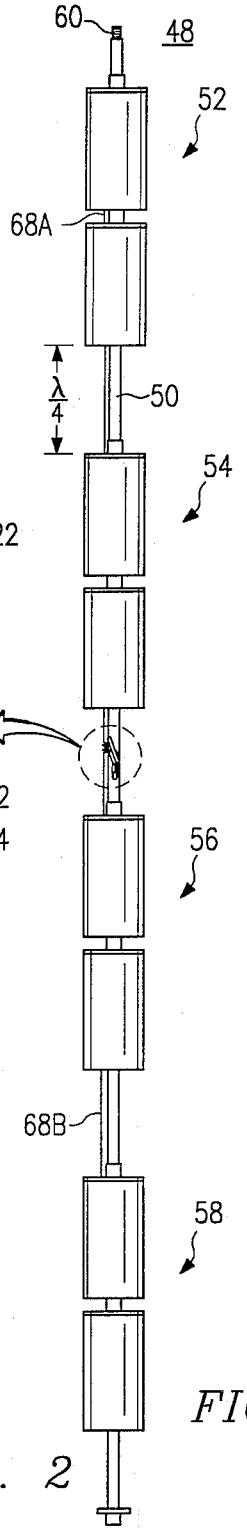
FIG. 2 is an elevation illustration of a plurality of dipole radiators in accordance with the present invention mounted on a common mast to form a high gain, omnidirectional antenna.

A further embodiment of the present invention is an antenna 48 illustrated in FIG. 2. A detail of the feed line structure is further illustrated in FIG. 2A. This antenna includes a plurality of dipole radiators 52, 54, 56 and 58. Each of these dipole radiators is the same as the dipole radiator 20 described in reference to FIG. 1. The dipole radiator 52, 54, 56 and 58 are spaced along a tubular mast 50 from each other by a distance which is approximately one quarter wave length for the selected center frequency.

The top of the mast 50 is provided with a threaded connector 60 for connection of additional mast sections that carry similar dipole radiators.

An opening 62 is provided in the mast 50 at a position in the center of the group of dipole radiators 52, 54, 56 and 58. A primary feed line 64 is positioned within the mast 50 and extends downward from the opening 62 to the base of the mast 50. A connection line 66 extends from the primary feed line 64 to a connection to a secondary feed line 68 which has an upper segment feed line 68A and a lower segment feed line 68B. A tuning stub 70 is connected to the upper end of the main feed line 64 at the junction with line 66 to provide impedance matching between the main feed line 64 and the secondary feed line 68.

The primary and secondary feed lines, such as 64 and 68 can be coaxial lines which have a metal outer conductor which can be soldered to the mast, such as 50, for support.

A single one of the dipole radiators, such as 52, 54, 56, and 58 has 0 DB gain. A combination of two of these dipole radiators provides 3 DB gain. The combination of four of the dipole radiators, as shown in FIG. 2 provides 6 DB of gain. Each doubling of the number of dipole radiators provides an additional 3 DB of gain for the antenna.

Figure 3:
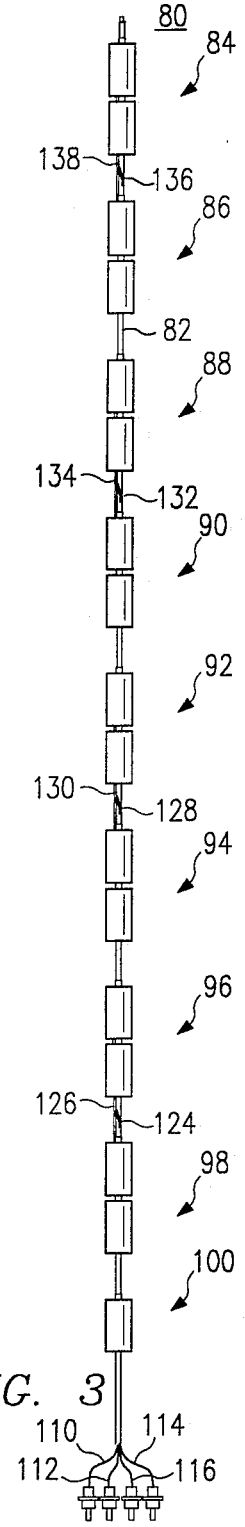
FIG. 3 is an elevation illustration of a plurality of dipole radiators in accordance with the present invention mounted on a common mast and having multiple feed lines.

A still further embodiment of the present invention is an antenna 80 which is illustrated in FIG. 3. This antenna includes a tubular mast 82 and a plurality of dipole radiators 84, 86, 88, 90, 92, 94, 96 and 98. Each of these dipole radiators is similar to the dipole radiator 20 described in reference to FIG. 1. This is a quad dipole antenna. Radiators 84 and 86 are a first antenna, 88 and 90 is a second, 92 and 94 is a third and 96 and 98 is a fourth antenna.

Antenna 80 is further provided with an RF choke 100. The choke 100 has a physical configuration the same as the combination of the cylindrical radiator element 32, end plate 34 and bushing 36 shown in FIG. 1. The choke 100 serves the function of suppressing RF energy produced by the dipole radiator 98. The RF choking aspect of the present invention is further described below in reference to FIG. 5.

The antenna 80 has four feed lines 110, 112, 114, 116. All four of these feed lines extend through the center of the mast 82. The feed line 110 extends from the base of the mast 82 upward to an opening 124 in the mast 82 where the feed line 110 is connected to a secondary feed line 126 that extends to the dipole radiators 96 and 98. The feed line 112 extends from the base of the mast 82 upward to an opening 128 which is located between the dipole radiators 92 and 94. A secondary feed line 130 is connected to the primary feed line 112 at the opening 128 and extends in opposite directions for connection to the dipole radiators 92 and 94. The feed line 114 extends upward to an opening 132 in the mast 82 located between the dipole radiators 88 and 90. A secondary feed line 134 is connected at the opening 132 to the main feed line 114 and is further connected to the dipole radiators 88 and 90. The feed line 116 extends upward to an opening 136 in the mast 82 where it is connected to a secondary feed line 138 that is in turn connected to the dipole radiators 84 and 86. The various secondary feed lines are connected to the dipole radiators in the same manner as shown in FIG. 1 and the feed line junctions are as shown in FIG. 2A. The feed lines 110, 112, 114 and 116 are internal to the mast 82 and the secondary feed lines 126, 130, 134 and 138 are external to the mast 82.

The antennas 48 and 80 described above are preferably mounted within a tubular dielectric housing (not shown) which provides protection from weather as well as provides mechanical support. This housing is preferably made of plastic or fiberglass.

Figure 4:
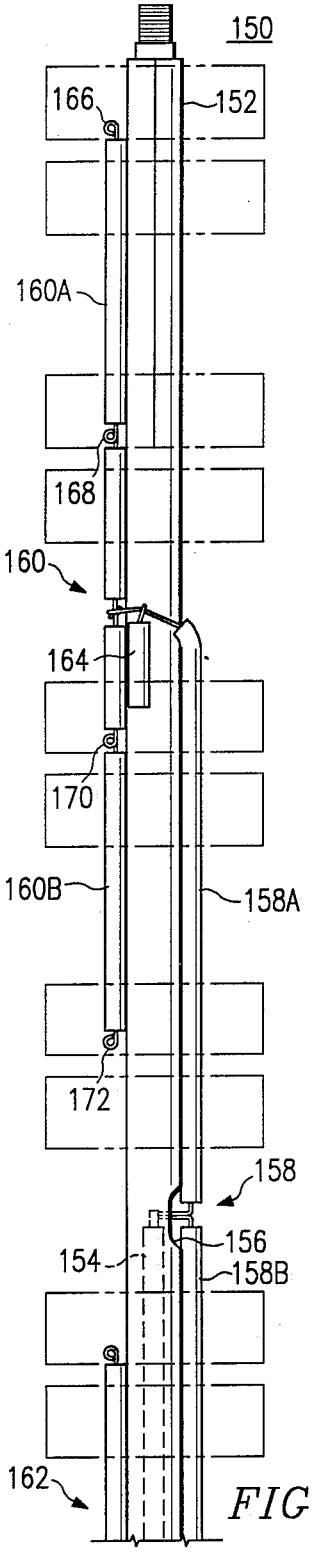
FIG. 4 is a detailed illustration of a feed line assembly in accordance with the present invention.

A still further aspect of the present invention is illustrated in FIG. 4. This is directed to a feed line configuration. A structure 150, which is a portion of an antenna that can include the dipole radiators previously described, includes a hollow tubular mast 152. A primary feed line 154 extends from the base of the mast 152 up to an opening 156. At the opening 156 the primary feed line 154 is connected to a secondary feed line 158 which has an upper segment feed line 158A and a lower segment feed line 158B. The secondary feed line 158 is positioned on the exterior of the mast 152. The upper segment feed line 158A extends upward from the opening 156 and is connected at the opposite end thereof to a tertiary feed line 160 which has an upper segment feed line 160A and a lower segment feed line 160B. The lower segment feed line 158B is likewise connected to a similar structure for a tertiary feed line 162.

The junction between the upper segment feed line 158A and the tertiary feed line 160 is provided with a tuning stub 164 for impedance matching. The tertiary feed line 160 is provided with connecting loops 166, 168, 170 and 172 for connection to dipole radiators, such as radiator 20 shown in FIG. 1. The dipole radiators are shown as dashed lines.

Figure 5:
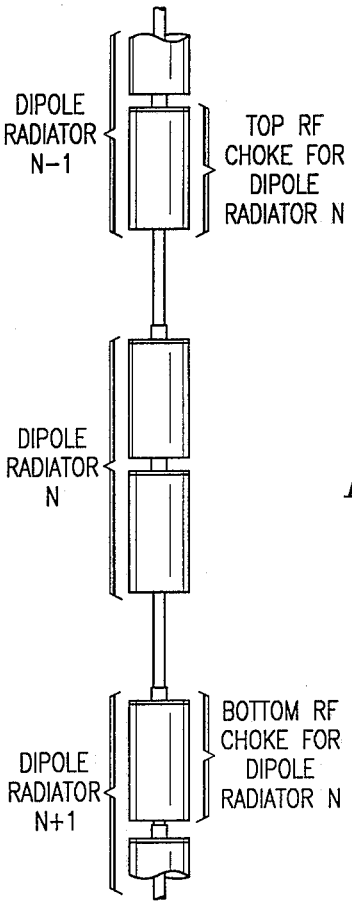
FIG. 5 is an illustration of a group of dipole radiators for illustrating RF choking between the dipole radiators.

A still further aspect of the present invention is illustrated in FIG. 5. The configuration of the present invention has the particular advantage that one element of each dipole radiator functions as an RF choke for the adjacent dipole radiator. In a multiple dipole radiator configuration, each dipole radiator not at an end can have an RF choke both above and below it. In FIG. 5, there are shown dipole radiators N−1, N and N+1. These dipole radiators, their connection to the mast and feed line connections are the same as shown in FIGS. 1–4. Note that for the dipole radiator N, the lower cylinder radiator element of the upper dipole radiator N−1 functions as an upper RF choke. Likewise, the upper cylindrical radiator element of the dipole radiator N+1 functions as a bottom RF choke for the dipole radiator N. Each dipole radiator produces RF current which upwards and downwards along the antenna. The adjacent cylindrical radiator elements, due to their ground connections to the mast, serve to choke off this RF current from an adjacent radiator. This action improves the antenna pattern.

Figure 6:
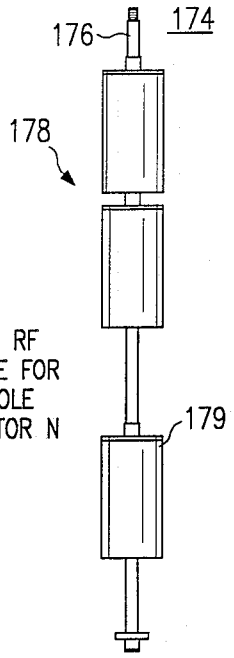
FIG. 6 is an illustration of a single dipole radiator in accordance with the present invention combined with a partial section of a dipole radiator which functions as an RF choke for the adjacent dipole radiator.

A further configuration of the present invention is illustrated as an antenna 174 in FIG. 6. The antenna 174 includes a tubular mast 176 and a dipole radiator 178, both the same as described for mast 22 and dipole radiator 20 in FIG. 1. However, the antenna 174 is further provided with an RF choke 179 at the lower end of the mast 176. The RF choke 179 has a structural configuration that is the same as the combination of the cylindrical radiator 32, end plate 34 and bushing 36 shown in FIG. 1. Choke 179 serves to suppress RF current produced by the dipole radiator 178.

Figure 7:
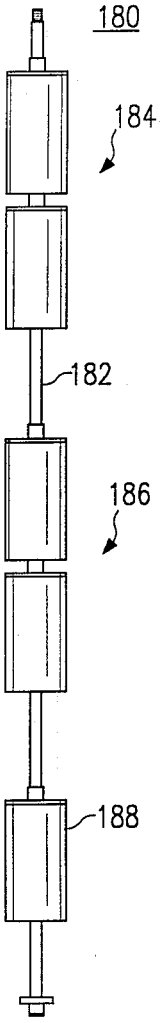
FIG. 7 is an illustration of an antenna in accordance with the present invention having two dipole radiators together with an RF choke.

A still further embodiment of the present invention is an antenna 180 illustrated in FIG. 7. The antenna 180 includes a tubular mast 182 which has mounted thereon dipole radiators 184 and 186. The dipole radiators 184 and 186 are the same as the dipole radiator 20 described in reference to FIG. 1. The antenna 180 further includes an RF choke 188 which is essentially the same as the choke 179 shown in FIG. 6. The choke 188 provides for suppression of RF energy produced by the dipole radiator 186.

The structure of the antenna of the present invention is easier to manufacture and repair than previous antenna designs, such as that shown in the MacDougall patent. This is principally due to the feed structure which places the secondary and tertiary feed lines on the exterior of the mast and to the direct metallic connecting of the cylindrical radiators to the mast.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. An omnidirectional antenna for operation over a band having a selected center frequency, comprising:

an electrically conductive, elongate mast, a plurality of dipole radiators mounted at spaced apart positions along said mast, each dipole radiator comprising:

a first cylindrical radiator element having an end plate at a first end thereof, said end plate having a center bushing with an opening therein for receiving said mast wherein said first radiator element is supported by said mast through said end plate and bushing thereof, a second cylindrical radiator element having an end plate at a first end thereof, said second radiator element end plate having a center bushing with an opening therein for receiving said mast and facing a second end of said first radiator element wherein said second radiator element is supported by said mast through said end plate and bushing thereof, the combined length and radius of each said radiator elements equal to approximately one quarter of the wavelength of said selected center frequency, the ratio of the diameter of said mast to the diameter of each of said cylindrical radiating elements is less than 0.5, said mast, said radiator elements and said end plates being DC electrically connected, a feed line supported by said mast and having a conductor thereof connected to opposite sides of each of said first radiator elements proximate said second end thereof, wherein said feed line comprises:

a primary feed line extending through the interior of said mast to an opening in said mast, said opening positioned at a midpoint of said plurality of dipole radiators mounted on said mast, a secondary feed line positioned exterior to said mast, connected to said primary feed line at said opening, extending in opposite directions along said mast from said opening, and connected through said conductor to each of said first radiator elements.

2. An omnidirectional antenna as recited in claim 1 wherein said first radiator element and said end plate thereof is a single unit and said second radiator element and said end plate thereof is a single unit.

3. An omnidirectional antenna as recited in claim 1 wherein said first radiator element and said end plate thereof are separate units joined together and said second radiator element and said end plate thereof are separate units joined together.

4. An omnidirectional antenna as recited in claim 1 including a third cylindrical radiator element having an end plate at a first end thereof, said third element end plate having an opening therein for receiving said mast wherein said third cylindrical radiator element is supported by said mast through said end plate thereof and is positioned on said mast offset from said dipole radiator and serves as an RF choke for said dipole radiator.

5. An omnidirectional antenna as recited in claim 1 wherein said first and second radiator elements are spaced apart along said mast by a distance equal to approximately 2 percent of the wavelength of a selected frequency of operation for said antenna.

6. An omnidirectional antenna, comprising:

an electrically conductive, elongate, hollow mast, a plurality of dipole radiators mounted at spaced apart locations along said mast, each dipole radiator comprising:

a first cylindrical radiator element coaxially mounted to said mast, a second cylindrical radiator element coaxially mounted to said mast offset from said first radiator element, a primary feed line extending from one end of said mast within said mast to an opening in said mast, said opening located at approximately a midpoint of said plurality of dipole radiators mounted along said mast, said primary feed line extending through said opening, a secondary feed line positioned external to said mast, connected to said primary feed line at said opening in said mast, and extending in opposite directions from said opening to first and second points along said mast, first and second tertiary feed lines connected to said secondary feed line respectively at said first and second points along said mast, and said first tertiary feed line connected to each of said first cylindrical radiator elements for a first half of said dipole radiators and said second tertiary feed line connected to each of said first cylindrical radiator elements for a second half of said dipole radiators.

7. An omnidirectional antenna as recited in claim 6 wherein said first radiator element includes an end plate which is a single unit and said second radiator element includes an end plate which is a single unit.

8. An omnidirectional antenna as recited in claim 6 wherein said first radiator element includes an end plate which comprises separate units joined together and said second radiator element includes an end plate which comprises separate units joined together.

9. An omnidirectional antenna as recited in claim 6 wherein each of said cylindrical radiating elements is supported by said mast through an end plate.

10. An omnidirectional antenna as recited in claim 9 wherein said end plate includes a bushing for receiving said mast therein.

11. An omnidirectional antenna as recited in claim 6 including a third cylindrical radiator element having an end plate at a first end thereof, said third element end plate having an opening therein for receiving said mast wherein said third cylindrical radiator element is supported by said mast through said end plate thereof and is positioned on said mast offset from a one of said dipole radiators located at the end of a series of said dipole radiators and said third radiator element serves as an RF choke for said end-located dipole radiator.

12. An omnidirectional antenna as recited in claim 6 wherein the combined length and radius of each of said cylindrical radiator elements is equal to approximate one quarter of the wavelength of the center frequency signal for the desired frequency band for said antenna.

13. An omnidirectional antenna as recited in claim 6 wherein the ratio of the diameter of said mast to the diameter of said cylindrical radiating elements is less than 0.5.

14. An omnidirectional antenna as recited in claim 6 wherein said first and second radiator elements are spaced apart along said mast by a distance equal to approximately 2 percent of the wavelength of a selected frequency of operation for said antenna.

15. An omnidirectional antenna as recited in claim 6 including respective feed line stubs connected to said secondary and tertiary feed lines at said first and second points to provide impedance matching between said secondary and tertiary feed lines.

16. An omnidirectional antenna as recited in claim 6 wherein said secondary and tertiary feed lines are positioned interior to the ones of said first and second radiator elements which are adjacent to said secondary and tertiary feed lines.

* * * * *